US007038366B2

(12) United States Patent
Williamson et al.

(10) Patent No.: US 7,038,366 B2
(45) Date of Patent: May 2, 2006

(54) FREE-STANDING STEM BARREL SUPPORTED MOUNT FOR HID LAMP

(75) Inventors: Glen P. Williamson, Manchester, NH (US); Ebon L. McCullough, New Ipswich, NH (US)

(73) Assignee: Osram Sylvania Inc., Danvers, MA (US)

( * ) Notice: Subject to any disclaimer, the term of this patent is extended or adjusted under 35 U.S.C. 154(b) by 269 days.

(21) Appl. No.: 10/814,468

(22) Filed: Mar. 31, 2004

(65) Prior Publication Data

US 2005/0218772 A1 Oct. 6, 2005

Related U.S. Application Data

(60) Provisional application No. 60/531,642, filed on Dec. 22, 2003.

(51) Int. Cl.
*H01J 5/48* (2006.01)
*H01J 17/16* (2006.01)

(52) U.S. Cl. ..... 313/287; 313/290; 313/49

(58) Field of Classification Search ..... 313/25, 313/634, 11, 17, 49, 290, 624, 283–285, 287, 313/318.01, 318.07, 318.1; 245/205.1, 316.1, 245/694

See application file for complete search history.

(56) References Cited

U.S. PATENT DOCUMENTS

| | | | | |
|---|---|---|---|---|
| 5,521,458 | A * | 5/1996 | Kulik, Jr. | 313/25 |
| 6,188,164 | B1 * | 2/2001 | Brown et al. | 313/25 |
| 6,575,415 | B1 * | 6/2003 | Williamson | 248/205.1 |
| 6,771,008 | B1 * | 8/2004 | Williamson | 313/49 |
| 6,963,158 | B1 * | 11/2005 | McCullough et al. | 313/25 |
| 2005/0046325 | A1 * | 3/2005 | McCullough et al. | 313/318.09 |

* cited by examiner

*Primary Examiner*—Karabi Guharay
*Assistant Examiner*—Dalei Dong
(74) *Attorney, Agent, or Firm*—William E Meyer

(57) ABSTRACT

A lamp capsule may be formed with substantially parallel-epipedial ends including alignments. A metal strap may surround one end, between the alignments, with first and second oppositely disposed affixation areas of extensions. A glass stem has tubular first portion with outside diameter D. A C-shaped clip is mounted upon the tubular first portion. The clip has height H and inside diameter D1 smaller than the outside diameter D. The clip frictionally engages the tubular first portion. A first frame member has a proximal terminus affixed to the clop and a second frame member has a proximal terminus affixed to the clip opposite the first frame member. The first frame member has a distal terminus affixed to the one affixation area and second frame member has a distal terminus affixed to the other affixation area. The first and second frame members and the metal strap provide the support for the capsule.

8 Claims, 1 Drawing Sheet

FREE-STANDING STEM BARREL SUPPORTED MOUNT FOR HID LAMP

CROSS-REFERENCE TO RELATED APPLCIATIONS

This application claims priority from Provisional Application No. 60/531,642 filed Dec. 22, 2003.

TECHNICAL FIELD

This invention relates to lamps and more particularly to structures for mounting light source capsules within outer envelopes. Still more particularly it relates to mount assemblies that are economical to fabricate, suitable for automation, and easily mounted to low-wattage lamps.

BACKGROUND ART

Mount assemblies for arc discharge lamps usually employ a discharge vessel mounted upon a frame. The frame is generally mounted by means of clips to the flare and extends longitudinally to the opposite end of a lamp envelope where it is held in place by either snubbers embracing the envelope wall or a ring, which engages a dimple, formed in the wall envelope. The flare itself comprises a tubular body that can carry the exhaust tubulation and seals the in-leads in a pinch seal. Previous assemblies have used bands and frame assemblies that were crimped onto a stem. Often, these assemblies were purchased parts that occasionally suffered damage in shipping. Further, the crimping and strapping operations necessary to mount the assembly to the stem have not been reasonably automatable. Such assemblies are expensive and require a great deal of manual operations to complete. The repetitious hand operations also had unacceptable ergonomic issues.

Some of these problems were solved with the provision of a substantially C-shaped clip formed from spring steel. The clip had a given height H and an inside diameter D. A pair of substantially oppositely located cutouts, each providing an extending flap, projected away from the clip.

Additionally, there was provided a mount assembly for a lamp that included a "U" shaped frame member extending the length of the mount assembly, from the flare to the opposite end of the lamp envelope. The frame had a first leg attached to one of the flaps and a second leg attached to the other of the flaps. The end of the frame, the "bight" of the U, attached to the opposite end of the lamp. This construction, while working well, required a special lamp envelope having multiple diameters. This construction is shown in pending U.S. patent application Ser. No. 10/155,541, filed May 24, 2002 and assigned to the assignee of the present invention.

DISCLOSURE OF INVENTION

It is, therefore, an object of the invention to obviate the disadvantages of the prior art.

It is another object of the invention to enhance mount structures for lamps.

It is yet another object of the invention to reduce the number of different envelopes used in lamp manufacture.

BEST MODE FOR CARRYING OUT THE INVENTION

For a better understanding of the present invention, together with other and further objects, advantages and capabilities thereof, reference is made to the following disclosure and appended claims in conjunction with the above-described drawings.

Figure 1:
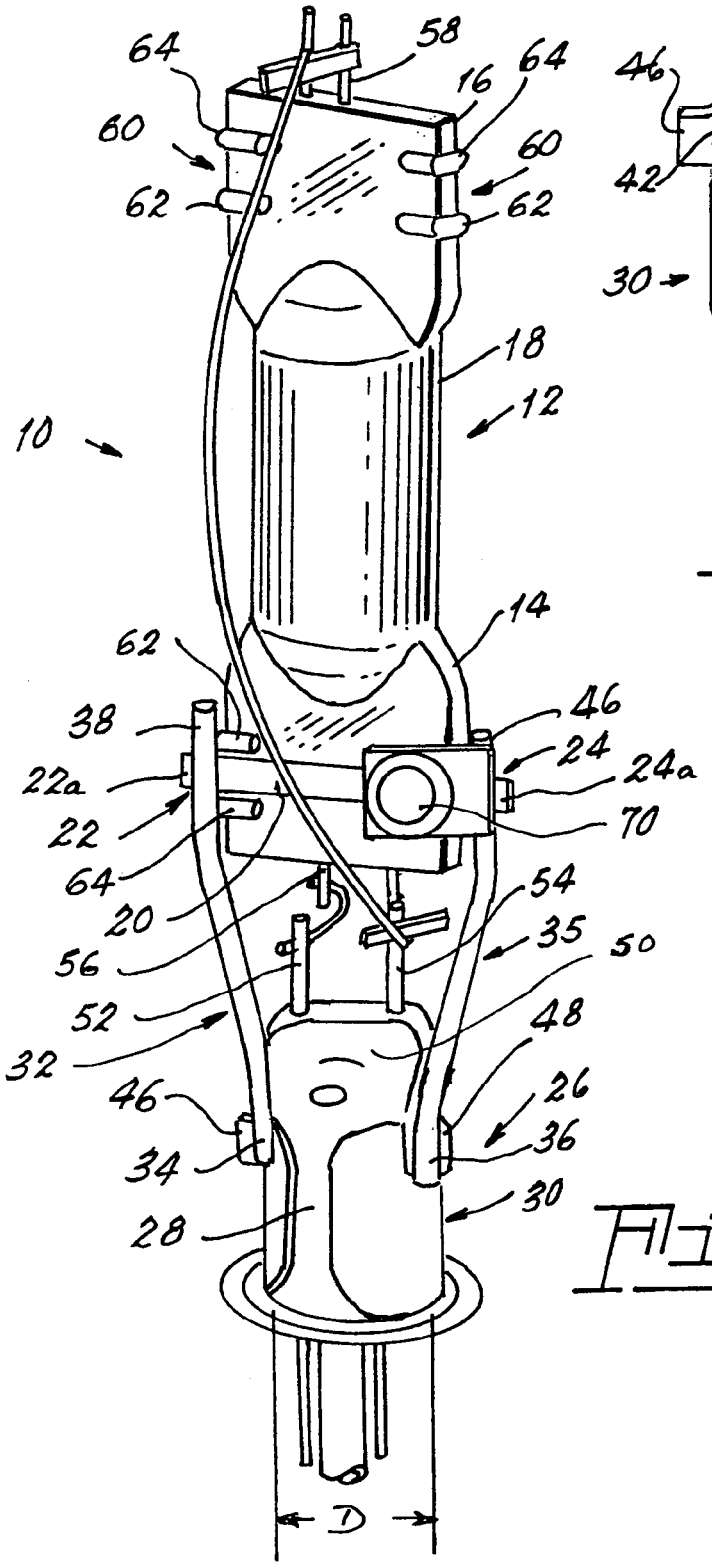
FIG. 1 is a perspective view of a lamp mount utilizing an aspect of the invention.

Referring now to the drawings with greater particularity there is shown in FIG. 1 a mount assembly 10 for a lamp that comprises a light source 12 having two ends 14, 16 separated by a hollow middle portion 18. Light source capsule 12 can be an arc discharge vessel and the ends 14 and 16 are substantially parallelepipedial. The ends 14 and 16 are also provided with alignment segments 60 in the form of spaced apart beads 62 and 64.

Figure 2:
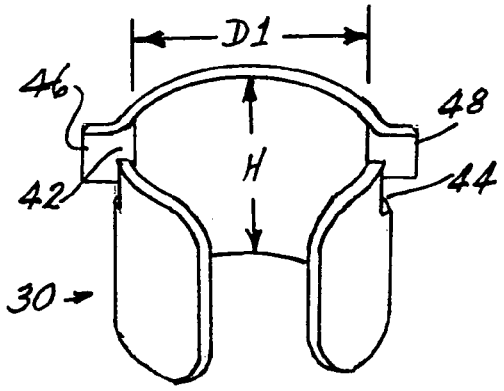
FIG. 2 is a perspective view of clip used with the invention.

A metal strap 20 surrounds one of the ends, for example, 14, and is positioned between the beads 62 and 64, and has first and second oppositely disposed affixation areas, 22, 24; which can be in the form of extensions 22*a* and 24*a*. A glass stem 26 has a tubular first portion 28 with an outside diameter D. A substantially C-shaped clip 30, shown separately in FIG. 2, is mounted upon the tubular first portion 28. The C-shaped clip 30 has a given height H and an inside diameter D1 that is smaller than the outside diameter D whereby the clip frictionally engages the tubular first portion. A first frame member 32 has a proximal terminus 34 affixed to the substantially C-shaped clip 30 and a second frame member 35 has a proximal terminus 36 affixed to the substantially C-shaped clip 30 opposite the first frame member 32. The first frame member 32 has a distal terminus 38 affixed to one of the affixation areas on metal strap 20, for example, area 22, and second frame member 35 has a distal terminus 40 affixed to the other of the affixation areas, for example 24. The first and second frame members 32 and 35 and the metal strap 20 constitute the sole support for the light source 12.

In a preferred embodiment of the invention the C-shaped clip 30 has oppositely located cutouts 42, 44, providing extending flaps 46, 48 to which are attached the proximal termini 32, 35.

Typically, the glass stem 26 has a second portion 50 formed as a pinch seal and containing the electrical lead-ins 52, and 54. These lead-ins are operatively connected to electrodes 56 and 58, located in opposite ends of the light source 12.

A getter 70 is attached to the metal strap 20 for removing unwanted gases formed during operation of the lamp. This position of the getter provides the desired gettering action whether the lamp is operated base up or base down. Although the temperature of the getter will be about 100° C. hotter during base up use it will still be within the desired operating range of between 335 and 450° C.

There is thus provided a lamp mount assembly that is rugged and easy to assemble and eliminates the need for a special lamp envelope.

While there have been shown and described what are at present considered to be the preferred embodiments of the invention, it will be apparent to those skilled in the art that various changes and modification can be made herein without departing from the scope of the invention as defined by the appended claims.

What is claimed is:

1. A mount assembly for a lamp comprising:

a light source having two ends separated by a hollow middle portion;

a metal strap surrounding one of said ends and having first and second oppositely disposed affixation areas;

a glass stem having a tubular first portion with an outside diameter D;

a substantially C-shaped clip mounted upon said tubular first portion, said C-shaped clip having a given height H and an inside diameter D1 that is smaller than said outside diameter D whereby said clip frictionally engages said tubular first portion; and a first frame member having a proximal terminus affixed to said substantially C-shaped clip and a second frame member having a proximal terminus affixed to said substantially C-shaped clip opposite said first frame member, said first frame member having a distal terminus affixed to one of said affixation areas on said metal strap and said second frame member having a distal terminus affixed to the other of said affixation areas, said first and second frame members and said metal strap constituting the sole support for said light source.

2. The mount assembly of claim 1 wherein a pair of substantially oppositely located cutouts is formed in said substantially C-shaped clip, each cutout providing an extending flap projecting away from said substantially C-shaped clip and wherein said first frame member proximal terminus is attached to one of said flaps and said second frame member proximal terminus is affixed to the other of said flaps.

3. The mount assembly of claim 2 wherein said glass stem has a second portion formed as a pinch seal and having a pair of electrical lead-ins sealed therein.

4. The mount assembly of claim 3 wherein said light source has electrodes in opposite ends and said electrical lead-ins are operatively connected to said electrodes.

5. The mount assembly of claim 4 wherein said two ends of said light source are substantially parallelepipedonal.

6. The mount assembly of claim 5 wherein at least one of said ends is provided with alignment segments for orientating said metal strap.

7. The mount assembly of claim 6 wherein said alignment segments comprise spaced apart beads.

8. A mount assembly for a lamp comprising:

a light source having two ends separated by a hollow middle portion;

a metal strap surrounding one of said ends and having first and second oppositely disposed affixation areas;

a glass stem having a tubular first portion with an outside diameter D and a second portion formed as a pinch seal having at least one dimension greater than D;

a substantially C-shaped clip mounted upon said tubular first portion, said C-shaped clip having a given height H and an inside diameter D1 that is smaller than said outside diameter D whereby said clip frictionally engages said first portion;

a pair of substantially oppositely located cutouts formed in said substantially C-shaped clip, each cutout providing an extending flap projecting away from said substantially C-shaped clip; and a first frame member having a proximal terminus affixed to a first of said flaps and a second frame member having a proximal terminus affixed to a second of said flaps, said first frame member having a distal terminus affixed to one of said affixation areas on said metal strap and said second frame member having a distal terminus affixed to the other of said affixation areas, said first and second frame members and said metal strap constituting the sole support for said light source.

* * * * *